US007347672B2

(12) United States Patent
Bertrand et al.

(10) Patent No.: US 7,347,672 B2
(45) Date of Patent: Mar. 25, 2008

(54) ROTOR DISK BALANCING DEVICE, DISK FITTED WITH SUCH A DEVICE AND ROTOR WITH SUCH A DISK

(75) Inventors: Jean-Louis Bertrand, Livry sur Seine (FR); Frederic Eichstadt, Livry sur Seine (FR); Joel Mathieu, Samois sur Seine (FR)

(73) Assignee: Snecma Moteurs, Paris (FR)

( * ) Notice: Subject to any disclaimer, the term of this patent is extended or adjusted under 35 U.S.C. 154(b) by 281 days.

(21) Appl. No.: 11/046,680

(22) Filed: Feb. 1, 2005

(65) Prior Publication Data

US 2005/0191181 A1 Sep. 1, 2005

(30) Foreign Application Priority Data

Feb. 6, 2004 (FR) ..... 04 50217

(51) Int. Cl.
*F01D 5/10* (2006.01)

(52) U.S. Cl. ..... 416/145; 416/144; 416/235; 416/500

(58) Field of Classification Search ..... 416/144, 416/145, 215, 218, 219 R, 220 R, 221, 234, 416/500; 74/572.2, 572.4, 572.21, 574.3, 74/574.4

See application file for complete search history.

(56) References Cited

U.S. PATENT DOCUMENTS 2,595,829 A * 5/1952 Dean ..... 416/221
3,039,739 A * 6/1962 Leland ..... 416/221
3,070,351 A * 12/1962 Hunt, Jr. ..... 416/221
3,291,446 A * 12/1966 Huebner, Jr. ..... 416/500
3,748,060 A 7/1973 Hugoson et al.
3,817,657 A * 6/1974 Hueber ..... 416/244 R
3,824,036 A * 7/1974 Penny et al. ..... 416/95
3,888,601 A 6/1975 Glassburn
4,343,594 A * 8/1982 Perry ..... 416/500
4,355,957 A 10/1982 Sifford et al.
4,803,893 A 2/1989 Bachinski
4,848,182 A 7/1989 Novotny
4,926,710 A 5/1990 Novotny
5,018,943 A 5/1991 Corsmeier et al.
5,281,098 A * 1/1994 Glynn et al. ..... 416/221
5,373,922 A 12/1994 Marra
6,428,272 B1 * 8/2002 Pepi et al. ..... 416/96 R
7,063,507 B2 * 6/2006 Hsieh ..... 416/144

FOREIGN PATENT DOCUMENTS

CH 290693 A * 8/1953 ..... 416/144
GB 805371 12/1958

* cited by examiner

*Primary Examiner*—Christopher Verdier
(74) *Attorney, Agent, or Firm*—Oblon, Spivak, McClelland, Maier & Neustadt, P.C.

(57) ABSTRACT

A rotor disc includes a rim and a balancing device, which includes housings formed in the rim, and balancing masses housed in at least some of the housings.

32 Claims, 2 Drawing Sheets

ROTOR DISK BALANCING DEVICE, DISK FITTED WITH SUCH A DEVICE AND ROTOR WITH SUCH A DISK

TECHNICAL DOMAIN

This invention relates to the technical domain of turbomachine rotors.

It is particularly applicable to a rotor disk balancing device. It is also applicable to a rotor disk equipped with such a device and a rotor equipped with such a disk.

STATE OF PRIOR ART

U.S. Pat. No. 3,888,601 describes a turbomachine fitted with a balancing device. It discloses a rotor disk provided with mobile blades around its periphery. Each mobile blade is fitted with an airfoil, a root and a platform located between the airfoil and the root. The disk comprises grooves around its periphery arranged along an axial direction in which the root of a blade will be fitted. When a blade is installed on the disk, its platform projects laterally on each side of the disk. Hooks formed in a single piece with the disk are arranged circumferentially on one side of the disk, at a spacing from each other. They comprise two opposite sidewalls arranged radially in coplanar alignment with the sidewalls of the blade assembly grooves. The disk or the rotor is balanced using balancing masses comprising a principal body and two tabs opposite each other, and each of which will be inserted between the two arms of a hook. According to this document, the blades are inserted in their corresponding grooves in the disk. Each balancing mass is then inserted so as to insert its tabs into a hook in the disk, making it slide in contact with the disk outwards along a radial direction, until it stops in contact with a blade platform. The balancing masses thus installed are then immobilized; they cannot move in the axial direction because their tabs are held in place in a hook, their outwards radial displacement is prevented by the platform that acts as a stop, and their inwards radial displacement is prevented by an elastic retaining ring placed in contact with the corresponding face of the disk. When balancing masses have to be replaced, the elastic retaining ring is withdrawn, the masses are withdrawn and new masses are installed to replace them.

The balancing device that has just been described has a disadvantage in that it is not suitable for a rotor disk of the integrally bladed disk type. It has another disadvantage in that this arrangement of disk balancing masses considerably increases the dimension of the disk in the axial direction. The thickness of the hooks, the dimension of the masses and of the platforms above them, all add to the axial dimension of the disk. Furthermore, if there is a set of several disks, the dimension of the turbomachine along the axial direction may become excessive.

U.S. Pat. No. 4,848,182 and U.S. Pat. No. 4,926,710 describe a balancing method and a system for a multidisk rotor with integral blade assembly. A balancing ring is fixed by shrinking onto a disk, such that its peripheral surface is in contact with a contact face of the disk on one side of the disk and is oriented radially inwards into the disk. The ring is stopped laterally in contact with the inside of the disk against a lip of the disk that extends radially outwards from the contact face. It is held laterally in place outwards from the disk by means of an elastic retaining ring. The ring comprises teeth around its outer periphery extending radially outwards, and that are separated by openings. When the ring is fixed on the disk, its teeth are in contact with the contact face of the disk. Consequently, the openings form cavities with the contact face and the lip of the disk, distributed around the circumference and opening laterally towards the outside of the disk. Several disks each equipped with their balancing ring are assembled together to form the rotor. The disk or rotor balancing process consists of inserting balancing masses in some of the cavities that are distributed around the circumference. The balancing masses are held in place laterally outwards from the disk by the elastic retaining ring, to prevent them from coming out of their cavity.

The balancing device that has just been described has a disadvantage in that the balancing masses are installed on a balancing ring. This requires the presence of a ring and an attachment operation by shrinking of its balancing ring on the disk.

PRESENTATION OF THE INVENTION

One purpose of this invention is to provide a balancing device for a disk and/or a rotor using balancing masses, which does not have the disadvantages of prior art described above.

According to a first aspect, the invention relates to a balancing device that is preferably applicable to a rotor disk of the integrally bladed type, the disk being provided with a rim. It comprises housings formed in said rim and balancing masses housed in said housings.

Preferably, these housings are located in a side face of the rim, under a platform of the disk that supports the blades, and are distributed around the circumference of the rim.

According to a first embodiment, the housings partially pass through the rim and are in the form of blind holes, with an orifice opening up onto a side face of the rim. According to a second embodiment, these housings pass through the rim and their orifices open up on first and second opposite lateral faces of the rim.

The shape of the housings and the masses is adapted to prevent a rotation or tipping of each mass in its corresponding housing.

The balancing device also comprises one or two spring retaining rings, designed to be positioned laterally against the rim, so as to at least partially close off the corresponding orifices of the housings. According to one variant, the spring retaining ring closes off at least half of the orifices. According to another variant, the spring retaining ring completely closes off the orifices. The spring retaining ring comprises at least one protuberance that fits into one of the housings, so that it does not rotate axially.

According to one variant, the balancing device comprises one or two circumferential slits formed under the platform into which a peripheral edge of a spring retaining ring will be fitted.

According to a second aspect, the invention relates to an integrally bladed rotor disk, that is equipped with a balancing device according to the first aspect of the invention.

According to a third aspect, the invention relates to a rotor, that comprises at least one disk according to the second aspect of the invention.

One advantage of the balancing device according to the invention lies in the fact that the mass housings form an integral part of the rim, which avoids the need for an additional part in which the balancing masses will fit. The result is a reduction of manufacturing costs and the rotor assembly time.

Another advantage of the balancing system according to the invention lies in the fact that the masses thus placed are easily accessible, and that it is possible to modify balancing of the disks or the rotor by modifying the distribution of balancing masses without the need to disassemble the rotor entirely.

Another advantage lies in the fact that with such a balancing device, it is possible to improve the correction of rotor out of balances.

BRIEF DESCRIPTION OF THE FIGURES

The invention will be better understood after reading the following detailed description of particular embodiments of the invention provided for illustration and that are in no way limitative, with reference to the appended drawings, wherein.

DETAILED PRESENTATION OF PARTICULAR EMBODIMENTS.

Figure 1:
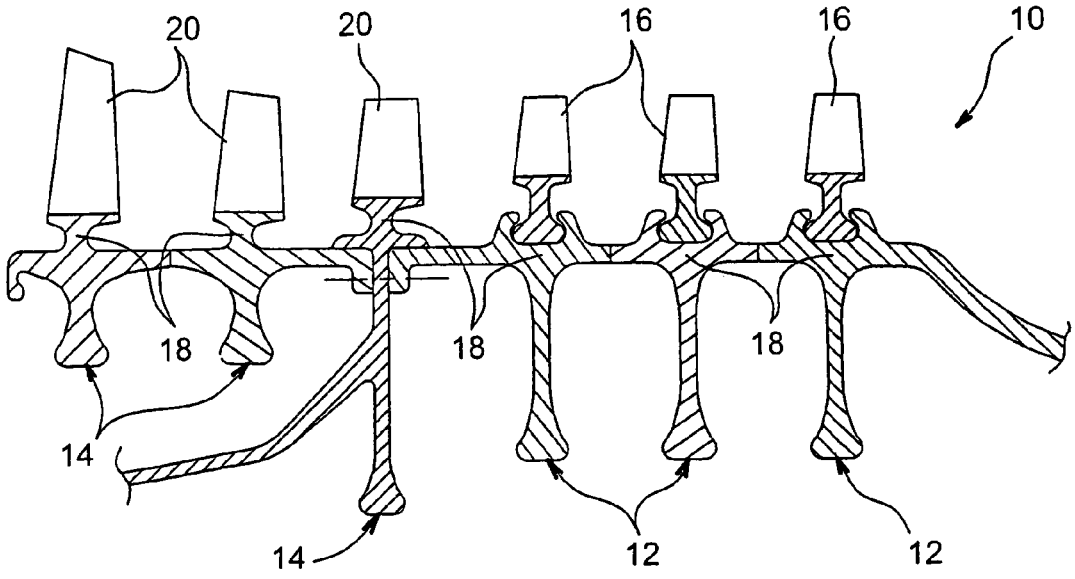
FIG. 1 is a partial representation of an axial section of a rotor that comprises integrally bladed disks and disks with removable blades.

Firstly with reference to FIG. 1, the figure generally shows a rotor 10 comprising six disks 12, 14. In the example illustrated, three of the disks (at the right in the figure) are disks 12 each with removable blades 16 fixed to the rim 18 of the disk. The other three disks (at the left in the figure) are integrally bladed disks 14, each with blades 20 being made integral with the rim 18 of the disk.

Figure 2:
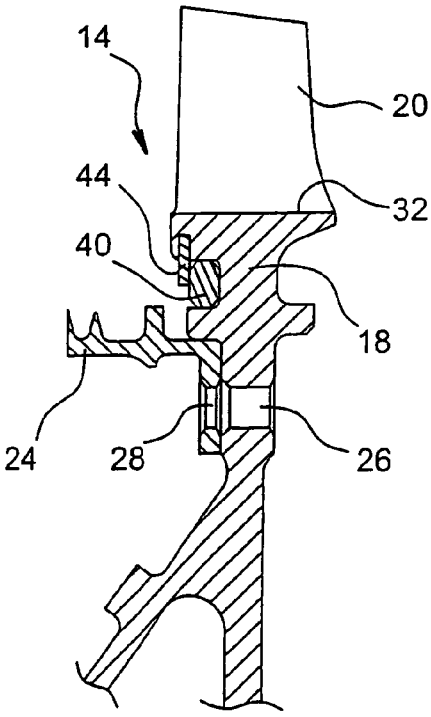
FIG. 2 is a partial representation of an axial section of a disk provided with a first embodiment of the balancing device according to the invention.
Figure 3:
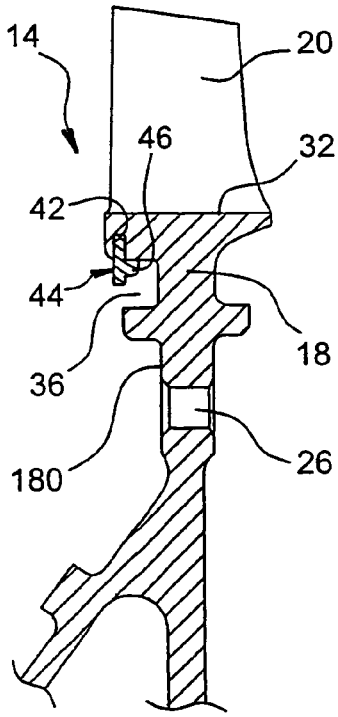
FIG. 3 is similar to FIG. 2, with another axial section.
Figure 4:
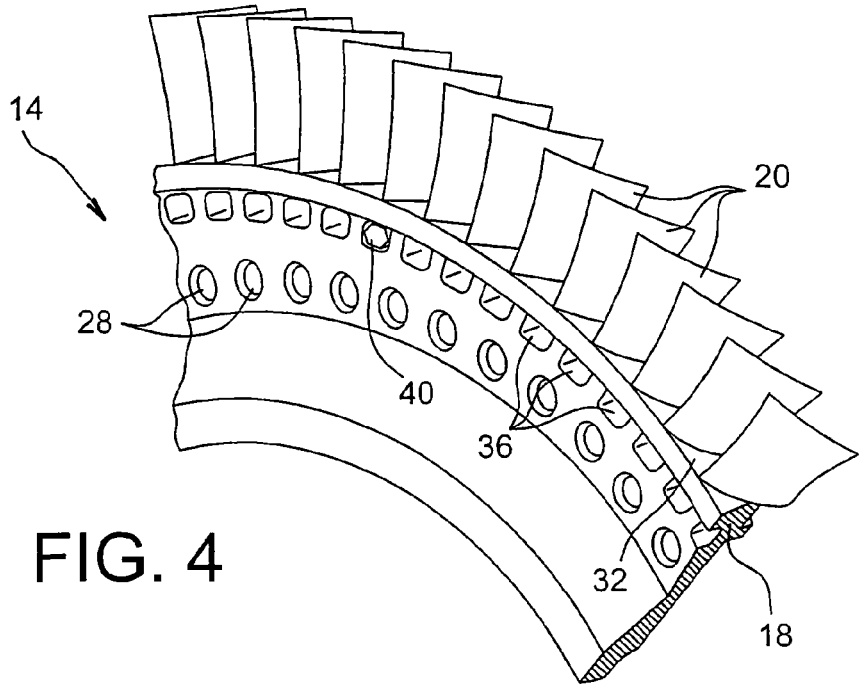
FIG. 4 is a partial representation of a perspective view of a disk fitted with the balancing device according to the invention.

FIGS. 2 to 4 illustrate an integrally bladed disk 14 comprising a rim 18 and blades 20 made integral with the rim 18. FIG. 2 shows a connection flange 24 that will be used to assemble the disk 14 with an adjacent disk (not shown) fixed to the disk 14 by attachment means for example such as screws passing through a drilling 26 in the rim and a drilling 28 in the connection flange 24.

The rim 18 is a thicker area, in which a face oriented radially outwards acts as platform 32 from which the blades 20 extend radially outwards.

Housings 36 are formed in the rim 18, and more particularly under the platform 32, and are distributed circumferentially around the rim 18. According to a first embodiment of the balancing device according to the invention, these housings 36 are in the form of blind holes opening up on a single side face 180 of the rim 18.

The disk and/or the rotor are balanced by placing balancing masses 40 in the housings 36. A mass 40 is placed in some housings 36, and no balancing mass is placed in other housings 36, depending on the need that becomes apparent during the balancing process.

In the example illustrated, the housings 36 have an approximately rectangular section with rounded corners, in the axial plane and/or the transverse plane. The balancing masses 40 are approximately in the shape of a rectangular parallelepiped, with dimensions corresponding to the dimensions of the housing 36, such that each balancing mass 40 fits into its housing 36 without it being able to rotate within it. Preferably, the edges of the rectangular parallelepiped are cut so as to form additional edges on the balancing mass 40, in order to further limit any rotation or tipping movements of the balancing mass 40 in its housing 36.

Preferably, the area of the rim 18 located between the platform 32 and the housings 36 overhangs slightly above the housings 36. In this overhanging part that projects laterally beyond the rim 18 over the housings 36, the rim 18 is provided with a circumferential slit 42 that is arranged in one face substantially opposite the platform 32 and that runs along the housings 36.

A spring retaining ring 44 is located in the slit 42, with a width such that it at least partially closes off the housings 36 so as to hold the balancing masses 40 in place.

Preferably, the spring retaining ring 44 is cut transversally so that it can be easily installed and removed.

Preferably, the spring retaining ring 44 is provided with an anti-rotation member 46 to prevent it from rotating in the transverse plane when it is installed in the slit 42 of the rim 18. This anti-rotation member is for example materialized by a protrusion 46 on the retaining ring 44 that is inserted into one of the housings 36 when it is not occupied by a balancing mass 40 (FIG. 3).

Figure 5:
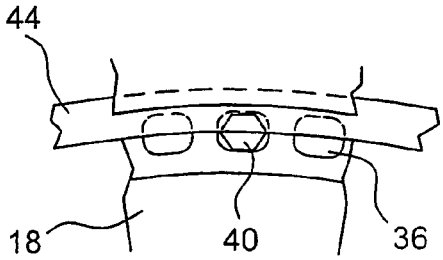
FIG. 5 is a partial front view of a first embodiment of the balancing device according to the invention.

FIG. 5 illustrates a front and partially enlarged view of a housing 36. In the example illustrated, the spring retaining ring 44 closes off approximately half of the housings 36. It would be possible for the spring retaining ring 44 to close off two thirds of the housings 36, or all housings 36. To prevent the balancing masses 40 from being able to exit from the housings 36, it is preferred that the spring retaining ring covers at least half of the housings 36.

According to another variant embodiment, the balancing masses 40 can also be fixed in the housings 36 by providing a small quantity of adhesive at the bottom of the housing before installing the balancing mass 40 in the housing, to guarantee that the balancing masses 40 will not come out of their housings 36.

Figure 6:
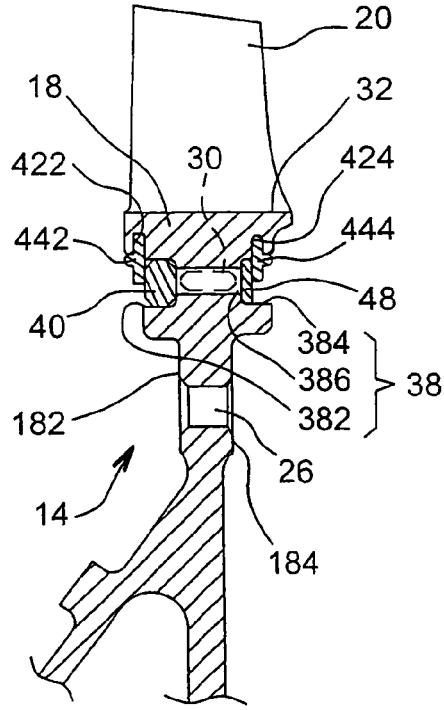
FIG. 6 is similar to FIG. 3, for a second embodiment of the balancing device according to the invention.

According to a second embodiment of the balancing device according to the invention illustrated in FIG. 6, the housings 38 are in the form of through holes that open up on each side of the rim 18. Preferably, these housings 38 are provided with a first cavity 382 similar to the housings 36 in the first embodiment and that open up on a first side face 182 of the rim 18. They also have a second cavity 384 approximately symmetrical to the first cavity 382 with respect to a median plane of the rim 18 and that opens up on a second side face 184 of the rim 18, opposite the first side face 182 of the rim. The two cavities 382, 384 are connected to each other by an intermediate channel 386 that, in the example illustrated, has a smaller cross section than the corresponding sections of the two cavities 382, 384.

The disk and/or the rotor are balanced in a similar manner to the balancing done with the first embodiment of the balancing device, described above. Consequently, the balancing masses 40 are placed in some of the first cavities 382, and a first spring retaining ring 442 is installed in a first slit 422 formed in a first part overhanging the first face 182 of the rim 18, so as to at least partially close off the first cavities 382 and to hold the balancing masses 40 in place.

The disk and/or the rotor could be balanced even more precisely by placing additional balancing masses 30 in some of the intermediate channels 386. These additional balancing masses, shown in dashed lines in FIG. 6, have a shape similar to the shape of the balancing masses 40, and dimensions adapted to the dimensions of the intermediate channels 386.

Still according to the second embodiment, sealing flanges 48 are provided to make the disk 14 leak tight. Preferably, they are placed at the bottom of the second cavities 384, and prevent any communication between the second cavities and the smaller intermediate channels 386. A second spring retaining ring 444 is installed in a second slit 424 formed in a second part overhanging the second face 184 of the rim 18, so as to at least partially close off the second cavities 384 and to hold the sealing flanges 48 in position.

The first spring retaining ring 442 and the second spring retaining ring 444, are preferably cut transversally so that they can be easily installed and removed.

The first spring retaining ring 442, and the second spring retaining ring 444, are preferably provided with an anti-rotation member (not shown), similar to the anti-rotation member on the spring retaining ring 44 according to the first embodiment of the device.

Closing off the housings 36 by the spring retaining ring 44 described with reference to FIG. 5 for the first embodiment of the balancing device is equally applicable to the second embodiment of the balancing device.

The invention that has just been described is not limited to the embodiments that have been described above. It is possible to make improvements and modification to these embodiments within the capabilities of those skilled in the art, without departing from the scope of the invention.

The invention claimed is:

1. A rotor disk comprising:

a rim;

a plurality of blades integral with said rim;

housings formed in said rim, said housings defining orifices that open up on a same side face of the rim;

balancing masses housed in a first plurality of said housings; and a spring retaining ring positioned laterally against the rim so as to only partially close off the orifices of the housings, wherein a second plurality of said housings is free of said balancing masses.

2. A rotor disk according to claim 1, wherein the housings are located under a platform that supports the plurality of blades.

3. A rotor disk according to claim 1, wherein the housings are distributed around the circumference of the rim.

4. A rotor disk according to claim 1, wherein the housings partially pass through the rim.

5. A rotor disk according to claim 1, further comprising a circumferential slit into which the spring retaining ring is fitted.

6. A rotor disk according to claim 1, wherein the spring retaining ring forms a protrusion designed to be fitted into one of the housings, to prevent the spring retaining ring from rotating axially.

7. A rotor disk according to claim 1, wherein the housings pass through the rim between a first side face and a second side face of the rim opposite said first face.

8. A rotor disk according to claim 1, wherein the shape of the housings and the balancing masses is adapted to prevent a rotation or tipping of the balancing masses in their corresponding housings.

9. A rotor disk according to claim 1, wherein said housings in said first and second pluralities of housings have a same shape.

10. A rotor disk according to claim 9, wherein said housings in said first and second pluralities of housings have a same size.

11. A rotor disk according to claim 10, wherein said housings in said first and second pluralities of housings are circumferentially distributed around said rim and radially positioned between said blades and a connection flange configured to connect said rotor disk to another adjacent rotor disk.

12. A rotor disk according to claim 10, wherein said first plurality of said housings that house said balancing masses and said second plurality of said housings that are free of said balancing masses are distributed around said rim such that said rotor disk is balanced.

13. A rotor disk according to claim 1, wherein said housings in said second plurality of housings that are free of said balancing masses have a shape and a size configured to receive said balancing masses.

14. A rotor disk comprising:

a rim;

a plurality of blades integral with said rim;

housings formed in said rim; and balancing masses housed in a first plurality of said housings, wherein a second plurality of said housings is free of said balancing masses, the housings pass through the rim between a first side face and a second side face of the rim opposite said first face, the housings comprise a first cavity defining an orifice that opens up on the first side face of the rim, a second cavity defining an orifice that opens up on the second face of the rim, and wherein said housings define an intermediate channel connecting the first and second cavities.

15. A rotor disk according to claim 14, wherein the balancing masses in said first plurality of housings are placed in the first cavities.

16. A rotor disk according to claim 15, further comprising balancing masses placed in the intermediate channels of said first plurality of housings.

17. A rotor disk according to claim 14, further comprising sealing flanges placed in the second cavities.

18. A rotor disk according to claim 14, further comprising a first spring retaining ring, designed to be positioned laterally against the rim, so as to at least partially close off the orifices of the first cavities and a second spring retaining ring designed to be positioned laterally against the rim, so as to close off the orifices of the second cavities.

19. A rotor disk according to claim 18, wherein the first spring retaining ring forms a protrusion fitted into one of the first cavities, to prevent the first spring retaining ring from rotating axially, and wherein the second spring retaining ring forms a protrusion fitted into one of the second cavities, to prevent the second spring retaining ring from rotating axially.

20. A rotor disk according to claim 18, further comprising a first circumferential slit into which the first spring retaining ring is fitted, and a second circumferential slit into which the second spring retaining ring is fitted.

21. A rotor disk according to claim 18, wherein each spring retaining ring closes off at least half of the orifices.

22. A rotor disk according to claim 21, wherein each spring retaining ring completely closes off the orifices.

23. A rotor disk according to claim 18, wherein each spring retaining ring closes off at least half of the orifices.

24. A rotor disk according to claim 23, wherein each spring retaining ring completely closes off the orifices.

25. A rotor disk according to claim 14, wherein the shape of the housings and the balancing masses is adapted to prevent a rotation or tipping of the balancing masses in their corresponding housings.

26. A rotor disk according to claim 14, wherein said housings in said first and second pluralities of housings have a same shape.

27. A rotor disk according to claim 26, wherein said housings in said first and second pluralities of housings have a same size.

28. A rotor disk according to claim 27, wherein said housings in said first and second pluralities of housings are circumferentially distributed around said rim and radially positioned between said blades and a connection flange configured to connect said rotor disk to another adjacent rotor disk.

29. A rotor disk according to claim 27, wherein said first plurality of said housings that house said balancing masses and said second plurality of said housings that are free of said balancing masses are distributed around said rim such that said rotor disk is balanced.

30. A rotor disk according to claim 14, wherein said housings in said second plurality of housings that are free of said balancing masses have a shape and a size configured to receive said balancing masses.

31. A rotor comprising:

at least one disk, said disk comprising a rim;

a plurality of blades integral with said rim;

housings formed in said rim, said housings defining orifices that open up on a same side face of the rim;

balancing masses housed in a first plurality of said housings; and a spring retaining ring positioned laterally against the rim so as to only partially close off the orifices of the housings, wherein a second plurality of said housings are free of said balancing masses.

32. A turbomachine comprising:

at least one rotor having at least one disk, said disk comprising a rim;

a plurality of blades integral with said rim;

housings formed in said rim, said housings defining orifices that open up on a same side face of the rim;

balancing masses housed in a first plurality of said housings; and a spring retaining ring positioned laterally against the rim so as to only partially close off the orifices of the housings, wherein a second plurality of said housings are free of said balancing masses.

* * * * *